US008511984B2

(12) United States Patent
Subbarao et al.

(10) Patent No.: US 8,511,984 B2
(45) Date of Patent: Aug. 20, 2013

(54) GAS TURBINE ENGINE EXHAUST DIFFUSER AND COLLECTOR

(75) Inventors: Manjunath Subbarao, Pearland, TX (US); Balakrishnan Ponnuraj, Sugar Land, TX (US); Harley Matthew Ross, Pearland, TX (US); Vic Chari, Houston, TX (US); Timothy Martin Christensen, Baytown, TX (US); Terrill Bryant Shipman, New Caney, TX (US); Vineet Sethi, Sugar Land, TX (US)

(73) Assignee: General Electric Company, Schenectady, NY (US)

( * ) Notice: Subject to any disclaimer, the term of this patent is extended or adjusted under 35 U.S.C. 154(b) by 1012 days.

(21) Appl. No.: 12/580,974

(22) Filed: Oct. 16, 2009

(65) Prior Publication Data

US 2011/0088398 A1 Apr. 21, 2011

(51) Int. Cl.
*F01D 25/30* (2006.01)

(52) U.S. Cl.
USPC ..... 415/211.2

(58) Field of Classification Search
USPC ..... 415/211.2, 177, 208.1; 60/324, 60/39.5, 902
See application file for complete search history.

(56) References Cited

U.S. PATENT DOCUMENTS

| | | | | |
|---|---|---|---|---|
| 3,552,877 | A * | 1/1971 | Christ et al. | 415/211.2 |
| 3,752,597 | A * | 8/1973 | Heinold et al. | 415/153.2 |
| 4,748,805 | A * | 6/1988 | Rigault et al. | 60/39.5 |
| 5,188,510 | A * | 2/1993 | Norris et al. | 415/208.1 |
| 5,257,906 | A * | 11/1993 | Gray et al. | 415/226 |
| 5,340,276 | A * | 8/1994 | Norris et al. | 415/208.1 |
| 5,603,604 | A * | 2/1997 | Norris et al. | 415/208.1 |
| 7,065,953 | B1 | 6/2006 | Kopko | |
| 7,107,774 | B2 | 9/2006 | Radovich | |
| 7,429,161 | B2 | 9/2008 | Senoo et al. | |
| 7,559,747 | B2 * | 7/2009 | Mohan et al. | 416/223 R |
| 7,780,403 | B2 * | 8/2010 | Fridsma | 415/148 |
| 2005/0172607 | A1 * | 8/2005 | Ishizaka et al. | 60/39.5 |
| 2008/0118359 | A1 * | 5/2008 | Mohan et al. | 416/223 A |
| 2009/0324400 | A1 * | 12/2009 | Marini et al. | 415/189 |
| 2011/0088398 | A1 * | 4/2011 | Subbarao et al. | 60/694 |
| 2011/0162369 | A1 * | 7/2011 | Myoren et al. | 60/722 |

* cited by examiner

*Primary Examiner* — Edward Look
*Assistant Examiner* — Christopher R Legendre
(74) *Attorney, Agent, or Firm* — Fletcher Yoder, P.C.

(57) ABSTRACT

Systems are provided that may be used to diffuse and deflect the flows of gas into a plurality of gas flows. A gas flow, for example, exhaust gas, may be diffused, that is, spread out by the diffuser. A flow deflector may be coupled to the diffuser so that the gas flow may result in a plurality of gas flows. By diffusing and allowing a plurality of gas flows, improved gas flows may be achieved.

25 Claims, 4 Drawing Sheets

GAS TURBINE ENGINE EXHAUST DIFFUSER AND COLLECTOR

BACKGROUND OF THE INVENTION

The subject matter disclosed herein relates to gas turbine engines, and more particularly, to gas turbine engine exhaust diffusers and collectors.

Power generation plants, such as combined cycle power plants, often incorporate a gas turbine engine. The gas turbine engine combusts a fuel to generate hot combustion gases, which flow through a turbine to drive a load, e.g., an electrical generator. At high velocities and temperatures, an exhaust gas exits the turbine and enters an exhaust diffuser-collector. Unfortunately, exhaust collectors and diffusers often consume a large space in the plant.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a gas turbine engine, an exhaust diffuser axially coupled to the gas turbine engine, a radial flow deflector axially coupled to the exhaust diffuser, and an exhaust collector axially coupled to the exhaust diffuser. The radial flow deflector is able to split an exhaust flow into an axial flow portion and a radial flow portion. The exhaust collector may collect gas diffused from the exhaust diffuser and deflected by the flow deflector and radially route the gas to other systems.

In a second embodiment, a system includes an exhaust diffuser that may diffuse an axial turbine exhaust and a flow deflector coupled to the exhaust diffuser. The flow deflector is capable of splitting the turbine exhaust flow into a radial exhaust flow portion and an axial exhaust flow portion.

In a third embodiment, a system includes a turbine diffuser retrofit kit. The retrofit kit may include a radial flow deflector. The radial flow deflector may include an annular wall having a diameter that gradually expands in an axial direction along the central axis of the radial flow deflector. A plurality of rods may be used to couple the radial flow deflector to an axial exhaust diffuser of a gas turbine engine.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
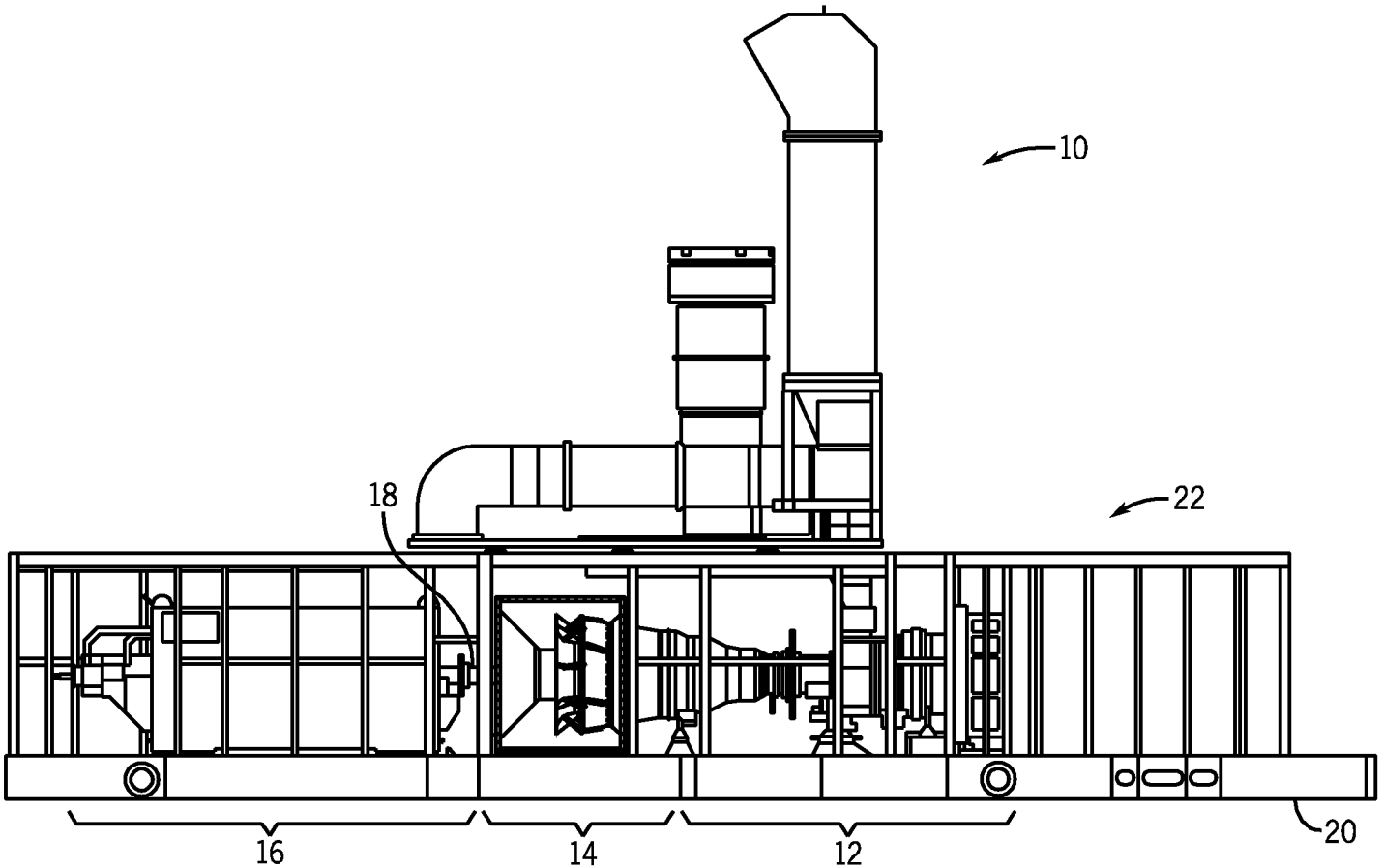
FIG. 1 is a diagram of an embodiment of a gas turbine power plant.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments include a gas turbine engine having an exhaust diffuser with both radial and axial diffuser portions (e.g., an axial/radial exhaust diffuser), which direct both axial and radial exhaust flows into a radial exhaust collector. The axial/radial exhaust diffuser may be a retrofit or an original component of the gas turbine engine. For example, the disclosed embodiments may include a retrofit kit configured to convert an axial exhaust diffuser into a radial exhaust diffuser or an axial/radial exhaust diffuser, thereby enabling use of a radial exhaust collector and associated exhaust conduits in a plant. The retrofit kit may include a radial deflector or flow splitter, e.g., a conical or bell-shaped wall, which redirects an axial exhaust flow at least partially into a radial direction (e.g., a radial exhaust flow portion and an axial exhaust flow portion). The radial deflector or flow splitter may be angled, curved, or generally oriented to turn the exhaust flow from the axial direction to the radial direction, while also reducing back pressure and turbulence. The radial deflection or split of the exhaust flow substantially reduces a horizontal distance or footprint sufficient to diffuse the exhaust gas. As a result, the retrofit kit enables installation of a gas turbine engine with an axial exhaust diffuser into an existing platform with a radial exhaust collector and exhaust conduits leading to other plant components such as to a heat recovery steam generation (HRSG) system. For example, the retrofit kit may enable an axial exhaust diffuser to mount directly into an existing radial exhaust collector without changes in size or exhaust connections. Although a retrofit kit is presently contemplated for a gas turbine engine, the disclosed embodiments are not limited to a retrofit kit.

Turning now to the drawing and referring first to FIG. 1, a diagram of a gas turbine engine power plant 10 is illustrated. A gas turbine engine 12, for example an aeroderivative gas turbine engine, is coupled to an exhaust diffuser-collector assembly 14. An example of such an aeroderivative gas turbine engine is manufactured by the General Electric Company of Schenectady, N.Y., under the designation LM6000. The diagram also depicts an electrical generator 16 coupled to the turbine engine 12 through a linkage 18. The gas turbine engine 12, exhaust diffuser-collector assembly 14, and electrical generator 16 may be securely attached to a skid platform 20. Clean air for combustion may be supplied by an air intake and filtration system 22. The air is compressed in a compressor section of the gas turbine engine 12 and mixed with a liquid fuel or gas fuel, such as natural gas. The fuel-air mixture is then combusted in a combustion chamber of the gas turbine engine 12. Hot pressurized gas resulting from the combustion of the fuel-air mixture then passes through a plurality of turbine blades in the gas turbine engine 12. The hot pressurized gas will cause the turbine blades to rotate, causing the rotation of the linkage 18. The rotation of the linkage 18 may drive a load, such as the electrical generator 16, as illustrated.

In one embodiment, the hot gas exits the gas turbine engine 12 in an axial direction and enters the exhaust diffuser-collector assembly 14 downstream of the gas turbine engine 12. The gas turbine engine 12 converts a portion of the energy in the hot gas into rotary motion. However, some useful energy may still remain in the hot exhaust gas. Accordingly, the exhaust diffuser-collector assembly 14 may capture and route the hot exhaust gas for further use, for example, by a HRSG system. The hot gas exiting into the exhaust diffuser-collector assembly 14 may be flowing at high velocities and contain high temperatures. By using the embodiments described in more detail with respect to FIG. 2 below, the gas turbine engine 12 may be coupled to a compact exhaust collector, such as a radial exhaust collector (e.g., LM5000 radial exhaust collector) manufactured by General Electric Company of Schenectady, N.Y. Indeed, compact exhaust collectors may be interfaced with gas turbine engines 12 capable an exhaust gas flow rate of upwards of 450 lbs/sec. Accordingly, the retrofit kit may include a high exhaust flow engine such as the LM6000, an axial exhaust diffuser as detailed below, a radial exhaust collector such as the LM5000, disclosed embodiments such as a flow deflector detailed below, and associated hardware.

Figure 2:
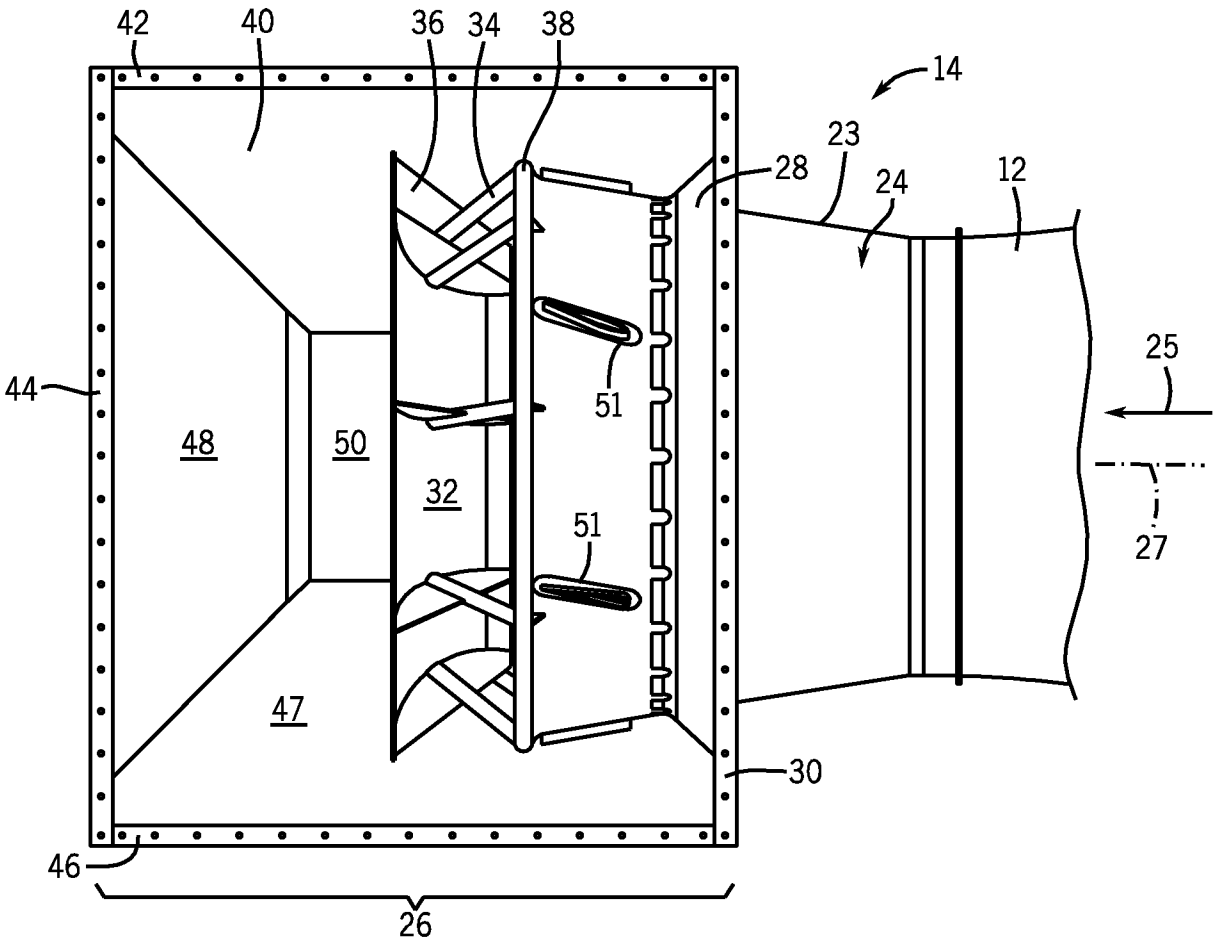
FIG. 2 is a perspective view of an embodiment of an exhaust diffuser-collector assembly.

FIG. 2 illustrates a perspective view of an embodiment of an exhaust diffuser-collector assembly 14, which includes an axial exhaust diffuser 24 coupled to a radial exhaust collector 26. As discussed in detail below, the axial exhaust diffuser 24 includes features to at least partially deflect the exhaust flow from an axial direction toward a radial direction to enable use of the axial exhaust diffuser 24 with the radial exhaust collector 26. The illustrated axial exhaust diffuser 24 has an annular wall 23, which gradually increases in diameter in a downstream direction 25 of exhaust flow from the gas turbine engine 12 toward the radial exhaust collector 26. For example, the annular wall 23 may be described as a conical or expanding annular wall, which diverges away from a longitudinal axis 27 in the downstream direction 25 of exhaust flow. The smaller diameter end of the axial exhaust diffuser 24 is coupled to the gas turbine engine 12 (portion shown) downstream of the gas turbine engine 12. The axial exhaust diffuser 24 diffuses (e.g., spreads out and reduces velocity of) an axial flow of the exhaust gas flowing from the gas turbine engine 12.

In one embodiment, the axial exhaust diffuser 24 includes a coupling disk 28. In this embodiment, the axial exhaust diffuser 24 is securely attached to the radial exhaust collector 26 by circumferentially bolting the coupling disk 28 to a retaining flange and a collector flange (see FIG. 3) included in a wall 30 of the radial exhaust collector 26. The flange and bolt attachment embodiments enable the axial exhaust diffuser 24 and the radial exhaust collector 26 to remain securely adjoined during the operation of the gas turbine engine 12, while also allowing for ease of maintenance and disassembly during periods of engine inactivity.

As mentioned above, the axial exhaust diffuser 24 includes features to at least partially deflect the exhaust flow from an axial direction toward a radial direction. As illustrated in FIG. 2, a flow deflector 32 is coupled to the axial exhaust diffuser 24 with a plurality of rods 34 at different circumferential positions. The flow deflector, as illustrated, may include an annular wall with a diameter that expands in a direction downstream of the axial exhaust diffuser 24. Each rod 34, for example, may be angled inwardly from the axial exhaust diffuser 24 toward the flow deflector 32 at equally spaced positions about the circumference of the flow deflector 32. In one embodiment, each one of the rods 34 may have a rectangular slot at a first end. A curved metal plate 36 may be inserted through the rectangular slot and may be welded to the first end of the rod 34. For example, the curved metal plate 36 may be a flat plate with a curved edge shaped to the contour of the flow deflector 32. The first end of the rod 34, including the curved metal plate 36, may then be attached to the exterior surface of the flow deflector 32, for example, by using welds. The rod's 34 second end may then be welded, for example, to a rear rim 38 of the axial exhaust diffuser 24. The multiplicity of attachment points provided by the plurality of rods 34 allow the flow deflector 32 to remain securely adjoined to the end of the axial exhaust diffuser 24 during operations of the gas turbine engine 12.

The radial exhaust collector 26 may include a collector chamber 40. The collector chamber 40 may include the inside region of the radial exhaust collector 26. That is, the collector chamber 40 may include the region bounded by the walls of the radial exhaust collector 26, including the right wall 30, a top wall 42, a left wall 44, a bottom wall 46, a back wall 47, and a front wall. The collector chamber 40 may be used, for example, to capture and redirect the gas flow exiting the gas turbine engine 12. A conical section 48 may project axially out of the left wall 44 and into the collector chamber 40. The conical section 48 may be used, for example, to radially disperse some of the gas flow, such that the gas flow does not directly impinge against the left wall 44 in the same axial direction. As illustrated, the conical section 48 diverges in the downstream direction 25 along the longitudinal axis 27, thereby gradually redirecting the exhaust flow from an axial direction to a radial direction.

A thermally-insulated bore 50 may be coupled to the conical section 48, extend into the collector chamber 40, pass through the axial exhaust diffuser 24, and couple with the gas turbine engine 12. For example, the thermally-insulated bore 50 may include one or more annular walls (or layers) of similar or different materials to provide thermal insulation and structural support. In one embodiment, a plurality of airfoil-shaped ribs 51 may extend radially from the circumference of the bore 50 and through the axial exhaust diffuser 24, securely coupling the bore 50 to the axial exhaust diffuser 24. In certain embodiments, the airfoil shape of the airfoil-shaped ribs 51 may be a symmetrical airfoil. That is, the airfoil's lower and upper cambers (i.e., curves) may be identical. The bore 50 may be coaxial with the longitudinal axis 27, e.g., approximately at the axial center of the inside hollow region of the axial exhaust diffuser 24. The bore 50 may surround the linkage 18 (see FIG. 1), thermally insulating the linkage 18 from the hot gas. The bore 50 may allow for the passage of the linkage 18 through the exhaust diffuser-collector assembly 14. The linkage 18 may pass through the exhaust diffuser-collector assembly 14, so that it may be coupled to a load, for example, the electrical generator 16.

A hot exhaust gas may be axially discharged by the gas turbine engine 12, exit through the axial exhaust diffuser 24, and impinge upon the flow deflector 32. In one embodiment, the flow deflector 32 may divide and deflect the flow into multiple flows as described with more detail with respect to FIG. 3 below.

Figure 3:
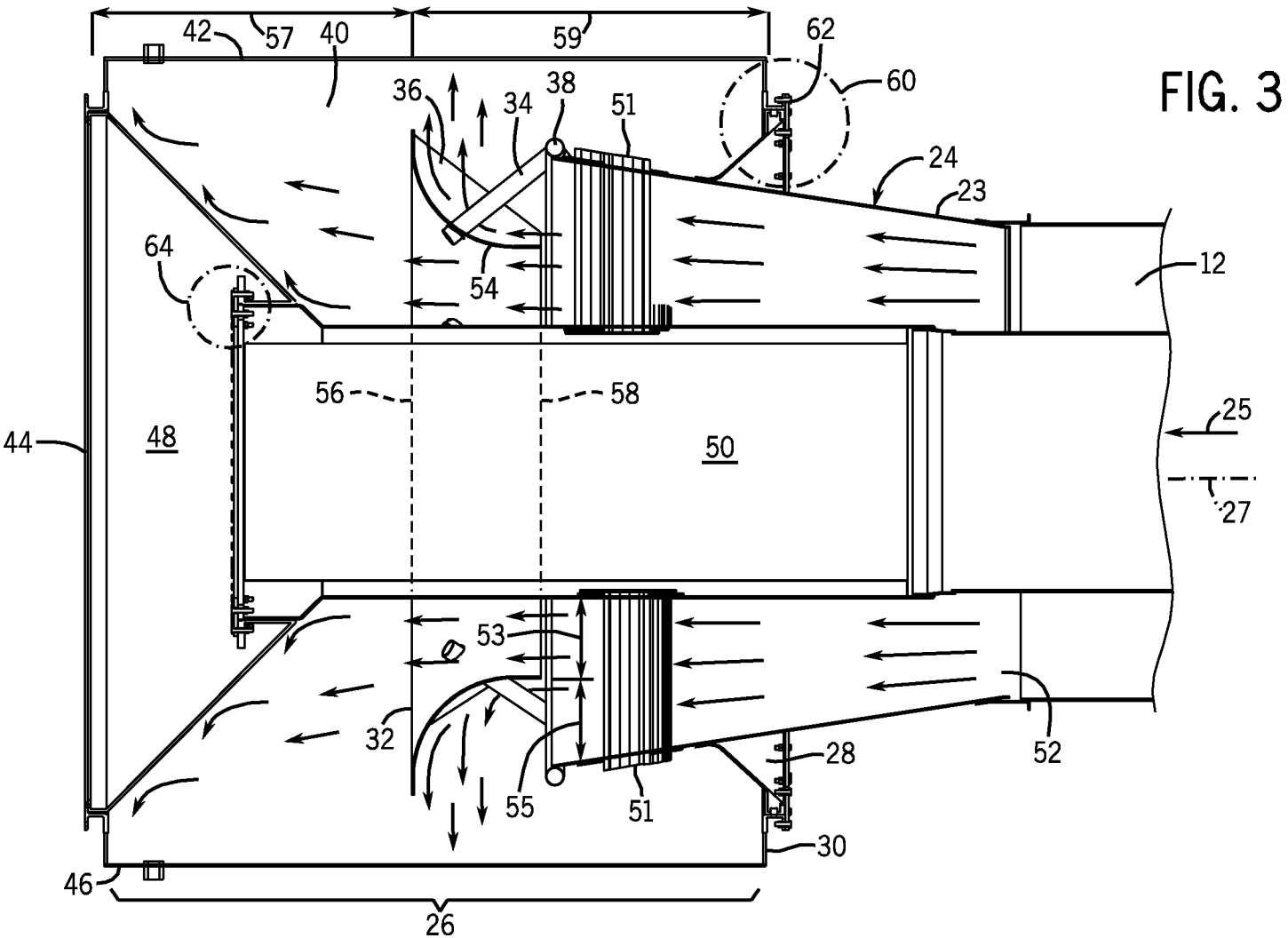
FIG. 3 is a cross-sectional view of an embodiment of an exhaust diffuser-collector assembly.

FIG. 3 depicts a cross-section view of the exhaust diffuser-collector assembly 14, including the flow deflector 32. A gas flow discharged from the gas turbine engine 12 may enter the gas discharge end 52 of the axial exhaust diffuser 24. In one embodiment, the gas discharge end 52 may have a circular shape that causes the exhaust discharge to form into an annular flow. The bore 50 may define a hollow center in the exhaust gas flow. Accordingly, the annular flow may be a toroidal flow (i.e., circular with a hollow center). The gas flow may continue exiting at a high velocity through the region formed by the inside surface of the axial exhaust diffuser 24 and the outside surface of the thermally-insulated bore 50. The gas flow may then exit the axial exhaust diffuser 24 and impinge upon the flow deflector 32.

The flow deflector 32 may include an expanding or diverging annular shape, such as a bell-shaped curvature 54. The flow deflector 32 including the bell-shaped curvature 54 may be manufactured, for example, by cutting a disk shape out of a metal sheet. The metal disk may then have a circular section removed from the center of the disk. The metal disk may then be stamped into having a shape including a bell-shaped curvature 54. The bell-shaped curvature 54 may have a curvature of approximately 30 to 150 degrees, 45 to 135 degrees, 60 to 120 degrees, 75 to 105 degrees, or approximately 90 degrees. In certain embodiments, the curvature 54 may be approximately 40, 65, 90, 115, or 140 degrees. For example, the bell-shaped curvature 54 may begin generally parallel to the longitudinal axis 27 (e.g., axial direction), and then turn approximately 90 degrees away from the longitudinal axis 27 (e.g., radial direction). In other embodiments, the difference between the first angle and the second angle relative to the longitudinal axis 27 may range from approximately 45 degrees to approximately 90 degrees. A wide end 56 of the flow deflector 32 may include a diameter of between 45 inches to 145 inches. A narrow end 58 of the flow deflector 32 may include a diameter of 20 inches to 100. However, the dimensions may vary from one implementation to another. For example, a ratio of the wide end 56 to the narrow end 58 may range between approximately 1.05 to 2, 1.05 to 1.5, or 1.1 to 1.3.

The radial exhaust deflector 32 may be placed concentrically and/or coaxially between the axial exhaust diffuser 24 and the central bore 50. Furthermore, the narrow end 58 may be radially centered or off-center between the axial exhaust diffuser 24 and the thermally-insulated bore 50. The radial position of the narrow end 58 may be defined by a first radial distance 53 between the bore 50 and the narrow end 58, and also a second radial distance 55 between the narrow end 58 and the axial exhaust diffuser 24. A ratio of the first radial distance 53 to the second axial distance 55 may range between approximately 0.5 to 1.5, 0.6 to 1.4, 0.7 to 1.3, 0.8 to 1.2, or 0.9 to 1.1. This ratio at least partially controls the split of exhaust flow between an axial exhaust flow portion (e.g., between the bore 50 and the flow deflector 32) and a radial exhaust flow portion (e.g., between the flow defector 32 and the axial exhaust diffuser 24). Accordingly, the ratio may be varied to control the flow, turbulence, stress, and other parameters within the assembly 14.

In one embodiment, the flow deflector 32 may be placed such that the narrow end 58 of the flow deflector 32 is approximately 0 inches to 20 inches from the rear rim 38 of the axial exhaust diffuser 24. In another embodiment, the flow deflector 32 may be placed such that the narrow end 58 of the flow deflector 32 penetrates into the interior region of axial exhaust diffuser 24 by approximately 0 inches to 10 inches. In certain embodiments, the wide end 56 of the flow deflector 32 may be placed in the middle region of the collector chamber 40, bisecting the collector chamber 40 into a left chamber section 57 and a right chamber section 59 of approximately equal sizes. In other embodiments, the wide end 56 of the flow deflector 32 may be placed approximately 5, 10, 20, 30 inches to the left or to the right of the middle region of the collector chamber 40, creating a left chamber section 57 and a right chamber section 59 of unequal sizes. For example, the left chamber section 57 may be defined as a first axial distance between the wide end 56 of the flow deflector 32 and the left wall 44, while the right chamber section 59 may be defined as a second axial distance between the wide end 56 of the flow deflector 32 and the right wall 30. A ratio of the first axial distance (e.g., 57) to the second axial distance (e.g., 59) may range between approximately 0.5 to 1.5, 0.6 to 1.4, 0.7 to 1.3, 0.8 to 1.2, or 0.9 to 1.1. This ratio may be varied to control the flow, turbulence, stress, and other parameters within the assembly 14.

Once the gas flow impinges upon the flow deflector 32, the gas flow may be split into two flows. A first flow (e.g., axial exhaust flow portion) may continue flowing axially through the region between the exterior surface of the thermally-insulated bore 50 and the interior surface of the flow deflector 32. The first flow may then enter the left section 57 of the collector chamber 40 and, for example, impinge upon the conical section 48. A second flow (e.g., radial exhaust flow portion) may impinge upon the bell-shaped outer edge of the flow deflector 32 and may be deflected radially along the entire circumference of the outer edge of the flow deflector 32. The second flow may then impinge, for example, on the top wall 42, bottom wall 46, and back wall 47, and front wall of the radial exhaust collector 26.

The multiple flows may then exit through an outlet opening of the radial exhaust collector 26. The outlet opening of the radial exhaust collector 26 may include a rectangular opening defined by the edges of the right wall 30, the top wall 42, the left wall 44, and the bottom wall 46, as illustrated. FIGS. 2 and 3 depict the outlet opening such that the axial exhaust diffuser 24 and flow deflector 32 may be seen inside the collector chamber 40 through the outlet opening. The outlet opening is such that the radial exhaust collector 26 can collect gas exiting in an axial direction from the turbine engine 12 and route the gas in a radial direction away from the axial exhaust diffuser 24 through the outlet opening. The gas exiting through the outlet opening may then be redirected, for example, into a HRSG, a bypass stack, and/or a selective catalytic reduction (SCR) system.

A set of flanges 60, including a diffuser flange on the end of the coupling disk 28, a collector flange on the radial exhaust collector 26, a diffuser flange, and an o-ring 62, may be used to securely seal the coupling between the axial exhaust diffuser 24 and radial exhaust collector 26. A similar set of flanges 64 may couple the thermally insulated bore 50 to the conical section 48. These flanges 60 and 64 are configured to block leakage of exhaust gas, and structurally secure the components together.

By splitting the exhaust gas flow into multiple flows, the gas flow exiting the exhaust diffuser-collector assembly 14 may exhibit a highly uniform flow velocity and problems such as back pressure may be eliminated. Indeed, the use of embodiments such as the flow deflector 32 may allow an axial exhaust diffuser 24 to be assembled inside a low volume radial exhaust collector 26. Such an assembly may result in a more compact exhaust diffuser-collector assembly 14.

Figure 4:
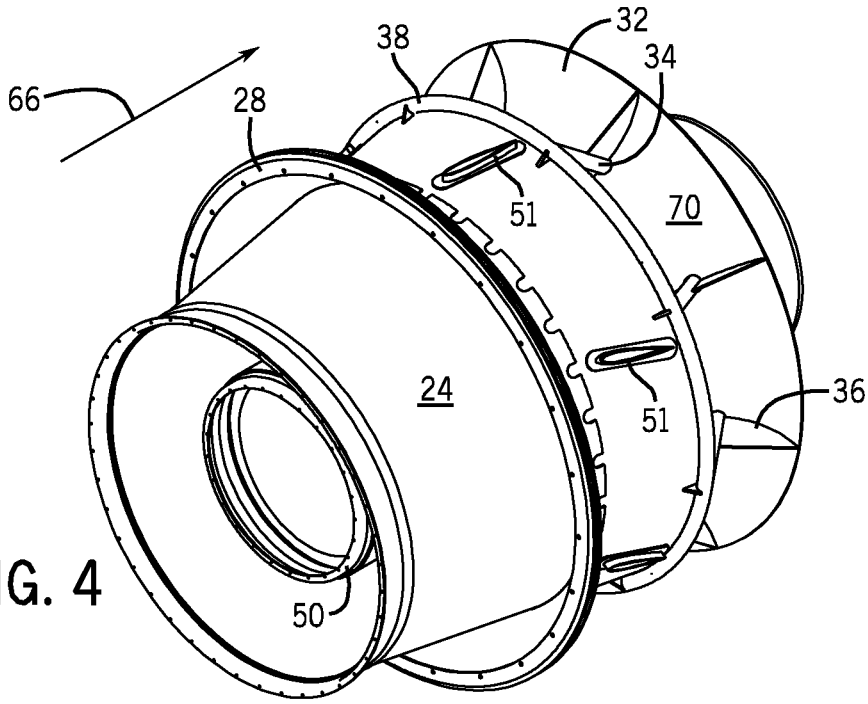
FIG. 4 is an isometric view of an embodiment of an axial exhaust diffuser; and, FIG. 5 is another isometric view of an embodiment of the axial exhaust diffuser of FIG. 4.
Figure 5:
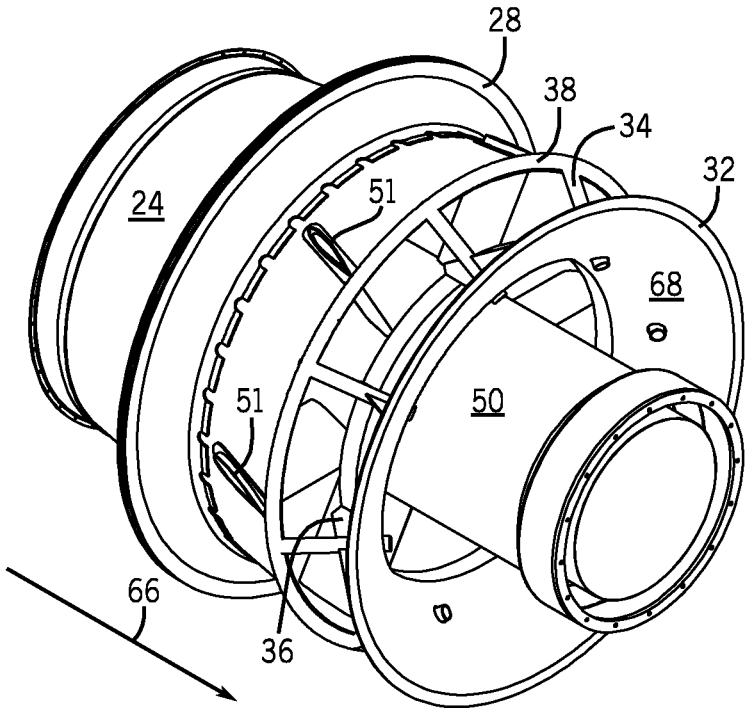

Turning to FIGS. 4 and 5, the figures depict different isometric views of the same axial exhaust diffuser 24 as shown in FIGS. 2 and 3, including the flow deflector 32. As mentioned above with respect to FIG. 2, the coupling disk 28 may be used to bolt the axial exhaust diffuser 24 to, for example, the radial exhaust collector 26 (see FIGS. 2 and 3). The flow deflector 32 may be coupled to the axial exhaust diffuser 24 by using the plurality of rods 34. A curved metal plate 36 may be positioned in a slot of the first end of the rod 34. Both the rod 34 and the metal plate 36 may then be attached, as illustrated, to the flow deflector 32. The second end of the rods 34 may then be attached to a plurality of locations around the circumference of the rear rim 38 of the axial exhaust diffuser 24.

FIG. 4 and FIG. 5 also depict the thermally-insulated bore 50 that may be used to thermally protect the linkage 18 (see FIG. 1) from the hot exhaust gas flow. The linkage 18 may be surrounded by the thermally-insulated bore 50 and thus may also be protected from direct contact with the hot exhaust gas. The thermally-insulated bore 50 may be coupled to the axial exhaust diffuser 24 through the use of airfoil-shaped ribs 51 placed around the circumference of the thermally-insulated bore 50. The airfoil-shaped ribs 51 may aid in stabilizing the gas flow in addition to circumferentially supporting the axial exhaust diffuser 24 around the thermally-insulated bore 50.

As mentioned above with respect to FIG. 3, exhaust may be discharged axially from the gas turbine engine in a direction 66 and exit as a toroidal gas flow through the axial exhaust diffuser 24. The gas flow may then encounter the flow deflector 32 and may split into two flow regions. One flow portion (e.g., axial exhaust flow portion) may continue exiting axially through the region between the inside surface 68 (see FIG. 5) of the flow deflector 32 and the bore 50, while a second flow portion (e.g., radial exhaust flow portion) may be deflected radially along the circumference of outer surface 70 (see FIG. 4) of the flow deflector 32 between the flow deflector 32 and the axial exhaust diffuser 24. The resulting division of the flows may greatly increase the uniformity of flow velocity vectors and may allow for the use of more compact radial exhaust collectors.

Technical effects of the invention include the ability to use compact exhaust diffuser-collector assemblies, improved uniformity in the gas flow of an exhaust gas exiting a turbine gas engine, improved back pressure prevention in compact exhaust collectors, and improved thermal gradient prevention of exhaust collector, exhaust diffuser, and duct components. Flow deflector embodiments are employed that allow for the separation of the gas flow into multiple flows, allowing for an enhanced flow of gas through compact environments such as exhaust diffuser-collector assemblies. Coupling embodiments are utilized to safely and efficiently connect exhaust diffusers to exhaust collectors and to allow for easy access and maintainability.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system comprising:

a gas turbine engine having a longitudinal axis;

an axial exhaust diffuser coupled to the gas turbine engine;

a radial flow deflector coupled to the axial exhaust diffuser by using a plurality of rods, wherein the radial flow deflector comprises a first annular wall having a circular opening disposed concentrically with respect to the axial exhaust diffuser, wherein the radial flow deflector splits an exhaust path into an axial flow portion and a radial flow portion; and, a radial exhaust collector disposed about the axial exhaust diffuser and the radial flow deflector, wherein the radial exhaust collector is configured to route exhaust gas along a radial path away from the longitudinal axis, wherein each of the plurality of rods does not extend past a wide end of the first annular wall.

2. The system of claim 1, wherein the first annular wall comprises a diameter that gradually expands in a downstream direction along the longitudinal axis.

3. The system of claim 2, wherein the first annular wall comprises a bell-shaped wall that curves from a first angle to a second angle relative to the longitudinal axis, wherein a difference between the first and second angles is at least approximately 45 degrees.

4. The system of claim 1, wherein the wide end of the first annular wall is disposed to bisect a chamber of the radial exhaust collector into two approximately equal sections.

5. The system of claim 1, comprising a thermally-insulated bore coupled to the axial exhaust diffuser, wherein the axial exhaust diffuser is disposed about the thermally-insulated bore.

6. The system of claim 5, wherein the axial exhaust diffuser is coupled to the thermally-insulated bore via a plurality of airfoil-shaped ribs.

7. The system of claim 1, wherein the exhaust gas comprises a flow rate of between 0 and 450 lbs/sec.

8. The system of claim 1, wherein the axial exhaust diffuser comprises a second annular wall with a diameter that gradually expands in a downstream direction along the longitudinal axis.

9. The system of claim 1, wherein the radial exhaust deflector is disposed concentrically between the axial exhaust diffuser and a central bore.

10. The system of claim 1, comprising only one of the annular wall.

11. The system of claim 10, wherein the radial exhaust collector comprises a chamber having a cone disposed on a downstream wall of the chamber, and wherein a wide end of the annular wall is disposed to evenly bisect the chamber.

12. The system of claim 11, wherein a narrow end of the annular wall is approximately between 0 inches to 5 inches from a rear rim of the axial exhaust diffuser.

13. The system of claim 10, wherein the axial exhaust diffuser is coupled to the chamber by using a collector flange, a diffuser flange, and an o-ring.

14. The system of claim 13, wherein the axial exhaust diffuser is coupled to the chamber by using only the collector flange, the diffuser flange, and the o-ring.

15. A system comprising:

a turbine exhaust diffuser configured to diffuse a turbine exhaust gas flow in an axial direction; and, a radial flow deflector coupled to the turbine exhaust diffuser, wherein the radial flow deflector comprises an annular wall having a circular opening disposed concentrically with respect to the turbine exhaust diffuser, and coupled to the turbine exhaust diffuser by using a plurality of support arms, wherein the radial flow deflector splits the turbine exhaust gas flow into a radial exhaust flow portion and an axial exhaust flow portion, and wherein the annular wall comprises a first diameter greater than a second diameter of the turbine exhaust diffuser, and wherein each of the plurality of support arms does not extend past a wide end of the annular wall.

16. The system of claim 15, comprising a gas turbine engine coupled to the turbine exhaust diffuser.

17. The system of claim 15, wherein the radial flow deflector comprises a bell-shaped wall.

18. The system of claim 17, wherein the bell-shaped wall curves from a first angle to a second angle relative to the axial direction, wherein a difference between the first and second angles is at least approximately 60 degrees.

19. The system of claim 15, wherein the turbine exhaust diffuser comprises a first annular wall with a first diameter that gradually expands in the axial direction, the radial flow deflector comprises a second annular wall with a second diameter that gradually expands in the axial direction, the first and second annular walls are coaxial with one another, and the second annular wall is disposed radially between the first annular wall and a third annular wall of a central bore.

20. The system of claim 19, wherein the radial flow deflector is coupled to the turbine exhaust diffuser via a plurality of circumferentially placed rods.

21. The system of claim 20, wherein the turbine exhaust diffuser is coupled to the central bore via a plurality of airfoil-shaped ribs.

22. A system comprising:

a turbine diffuser retrofit kit, comprising:

a radial flow deflector comprising a first annular wall with a first diameter that gradually expands in an axial direction along a central axis of the radial flow deflector; and a plurality of rods configured to couple the radial flow deflector to an axial exhaust diffuser of a gas turbine engine, wherein the first annular wall comprises a circular opening and wherein the radial flow deflector is configured to be disposed downstream of the exhaust diffuser so that the circular opening is concentric with respect to the axial exhaust diffuser and so that a wide end of the first annular wall bisects a chamber of the axial exhaust diffuser into a first section having a first axial distance and a second section having a second axial distance, and wherein a ratio between the first axial distance to the second axial distance is approximately 0.9 to 1.1, and wherein each of the plurality of rods does not extend past a wide end of the first annular wall.

23. The system of claim 22, wherein the first annular wall comprises a bell-shaped wall that curves from a first angle to a second angle relative to the axial direction, wherein a difference between the first and second angles is at least approximately 75 degrees.

24. The system of claim 22, comprising the axial exhaust diffuser retrofitted into a turbine system by using the turbine diffuser retrofit kit, wherein the axial exhaust diffuser comprises a second annular wall with a second diameter that gradually expands in the axial direction along the central axis, and the first and second annular walls are coaxial with one another.

25. The system of claim 24, comprising a radial exhaust collector disposed about the axial exhaust diffuser with the radial flow deflector, wherein the radial exhaust collector comprises a conical wall downstream from the axial exhaust diffuser.

* * * * *